US007273349B2

(12) United States Patent
Cartwright

(10) Patent No.: US 7,273,349 B2
(45) Date of Patent: Sep. 25, 2007

(54) FABRIC FAN BLADE AND FAN BODY TRIM

(76) Inventor: Thomas Cartwright, 365 NE. Baker Rd., Stuart, FL (US) 34996

( * ) Notice: Subject to any disclaimer, the term of this patent is extended or adjusted under 35 U.S.C. 154(b) by 0 days.

(21) Appl. No.: 11/502,586

(22) Filed: Aug. 10, 2006

(65) Prior Publication Data

US 2007/0059180 A1 Mar. 15, 2007

Related U.S. Application Data

(63) Continuation of application No. 10/841,975, filed on May 7, 2004, now Pat. No. 7,101,153.

(60) Provisional application No. 60/468,875, filed on May 8, 2003.

(51) Int. Cl.
*F04D 29/34* (2006.01)

(52) U.S. Cl. ..... 416/62; 416/225; 416/226; 416/5

(58) Field of Classification Search ..... 416/5, 416/62, 70 A, 120, 225, 226
See application file for complete search history.

(56) References Cited

U.S. PATENT DOCUMENTS 4,676,721 A 6/1987 Hardee
D309,183 S 7/1990 Taylor, III
5,110,261 A 5/1992 Junkin
5,338,156 A 8/1994 Chien
5,462,407 A 10/1995 Calvo
5,470,205 A 11/1995 Conklin, Jr.
5,516,264 A 5/1996 Anetrini
5,564,900 A * 10/1996 McAuley ..... 416/62
5,591,005 A * 1/1997 McCready ..... 416/62
D433,119 S * 10/2000 Frampton ..... D23/413
6,146,097 A * 11/2000 Bradt ..... 416/5
6,390,778 B1 5/2002 Lee
6,419,451 B1 7/2002 Moody et al.
6,619,920 B1 * 9/2003 Cannon ..... 416/62
6,811,377 B2 11/2004 Tang

* cited by examiner

*Primary Examiner*—Igor Kershteyn
(74) *Attorney, Agent, or Firm*—Hiscock & Barclay, LLP

(57) ABSTRACT

The conventional fan blade is replaced by a frame over which any of a wide range of decorative fabrics or other similar materials is drawn and secured by a clamping method to form a lightweight fan blade of any surface design desired by the user. The decorative fabric replaces the heavy fan blade while still providing its function of air circulation. The same decorative fabrics or other similar materials are also used as coverings or trim for the body of the fan motor housing. The fan blade frame may take any shape suitable for causing the circulation of air as by a conventional fan blade. Elimination of the fan blade mass of conventional designs makes possible significant reductions in power consumption, and significant reductions in stress, wear, and tear on the fan's ceiling mountings.

28 Claims, 13 Drawing Sheets

FABRIC FAN BLADE AND FAN BODY TRIM

CROSS-REFERENCE TO RELATED APPLICATIONS

This is a continuation of U.S. patent application Ser. No. 10/841,975 filed May 7, 2004 now U.S. Pat. No. 7,101,153 which claims the priority of U.S. provisional patent application Ser. No. 60/468,875 filed May 8, 2003.

FIELD OF THE INVENTION

This invention relates to ceiling fans, and relates more specifically to ceiling fan blades with decorative appearance and their fabrication and mounting.

BACKGROUND OF THE INVENTION

Ceiling fans provide both air circulation and decoration to the rooms in which they are mounted. Conventional ceiling fans have long blades made of wood or other rigid materials which circulate air upward or downward according to the pitch of the blades and the direction of rotation of the set of blades. There are disadvantages to these conventional fans. First, the blades are large and heavy, adding considerable weight to the fan and thereby stressing the fan's mounting in the ceiling. Often such blades are not properly matched in weight, and when the fan is turning, the weight imbalance of such unmatched blades causes the entire fan to wobble on its ceiling mounting, thereby putting additional stress on the mounting and presenting a risk of mounting failure. Mounting failure results in the falling of the fan from the ceiling.

Second, the weight of the blades necessitates use of a large fan motor, to drive the blades through the air at any of the desired speeds of the fan. The size of the motor dictates the amount of electrical power it consumes and the larger motors consume more power.

Third, the composition and mounting requirements of the blades restrict the role the fan can play in the decorative scheme of the room in which the fan is mounted. A change in decor can make the fan appear out of place in the room. Given the makeup of the fan blades, the only means of solving this problem is to paint the blades a different color, or to coat them in some manner with a decorative layer.

Several patents provide for decorative covering of the fan blades. U.S. Pat. No. 5,947,686, "Fan blade covers" (Keyes) teaches the use of sleeves made of cloth or other flexible, washable material to cover each fan blade, with each sleeve secured by tabs of material. U.S. Pat. No. 5,591,006 "Decorative cover for ceiling fan blade" (DeMeo, et al.) teaches the use of sleeves made of stretchable fabric which are held in position by friction caused by the tightness of fit of the fabric against the fan blade surface. U.S. Pat. No. 6,019,479 "Multi-fastening, one-piece, decorative fan blade cover and strobe light" (Barker) teaches the use of folding covers with tabs and slots for securing the covers over the fan blades. All of these approaches to changing the appearance of the fan blades add weight and bulk to the fan and blades, which are already heavy. Furthermore, none of these conventional approaches substantially changes the shape of the fan blade.

SUMMARY OF THE INVENTION

The invention replaces the conventional fan blade with a frame over which any of a wide range of decorative fabrics or other similar materials is drawn and secured by a clamping method to form a lightweight fan blade of any surface design desired by the user. The decorative fabric thus replaces the heavy fan blade while still providing its function of air circulation. The frame of the invention may take any of a number of shapes suitable for causing the circulation of air as by a conventional fan blade. The invention permits the user to apply the same decorative fabrics or other similar materials on the fan blades to coverings or trim for the body of the fan motor housing.

BRIEF DESCRIPTION OF THE DRAWINGS

FIGS. 31 and 3J show a top view of each of two different fans according to the invention, using the fan blades of FIGS. 3C and 3F respectively.

DETAILED DESCRIPTION OF THE INVENTION

The invention comprises a set of fan blades. Each fan blade is made by stretching fabric over a rigid frame or hoop and securing the fabric tightly to the frame, as shown in FIGS. 1 and 2A through 2D. The fabric forms the operating surfaces of the fan blade. The invention's fan blade design uses a simple and quick method for putting fabric onto a fan blade, and onto the fan body or motor housing, without the use of tools or extensive procedures.

Figure 1:
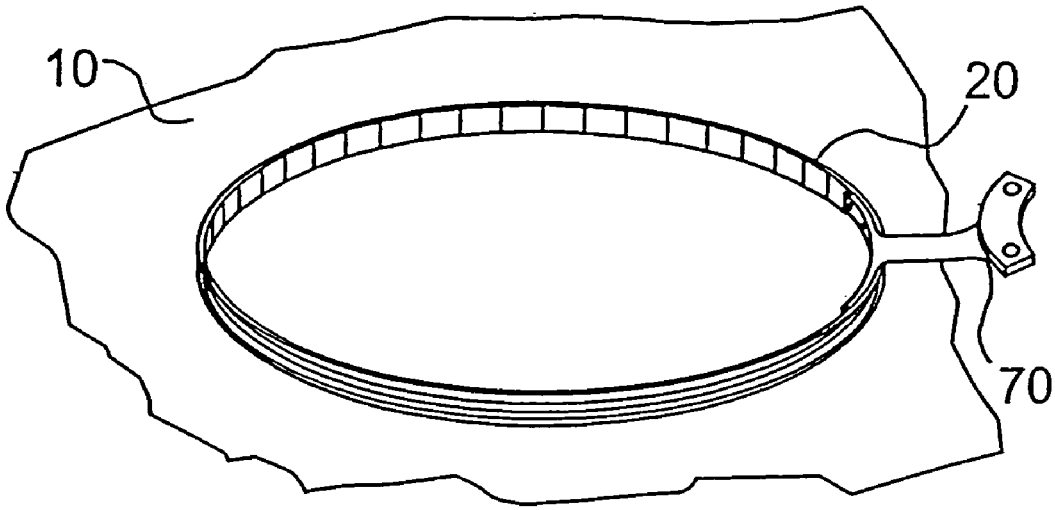
FIG. 1 shows the invention's fan blade frame and a piece of fabric to be used for the fan blade.

In the first step, shown in FIG. 1, a fabric 10 is laid flat, the fan blade frame 20 is then laid on top of the fabric 10 to allow the fabric 10 to be cut to the approximate size needed to be stretched across the fan blade frame 20 and anchored. The fabric 10 may be any woven or knitted natural cloth such as cotton, linen, or silk, or it may be any woven or knitted synthetic cloth such as nylon, rayon, or acetate, or it may be any uniform flexible flat substance capable of being stretched across a frame and anchored to the frame, such as treated canvas, plastic film, or leather. The fabric 10 may carry any design or pattern desired, in any desired colors. The fan blade frame 20 may be made of any solid material, such as wood, metal, or plastic, capable of supporting the weight of the stretched fabric, the tension of the stretched fabric, and the rotational and acceleration stresses of the fan's operation.

Figure 1A:
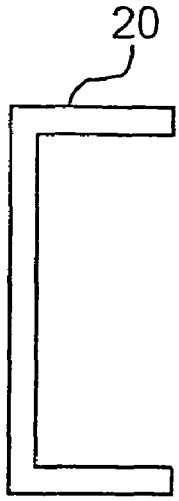
FIGS. 1A through 1F show different methods of attaching the fabric to the fan blade frame to form a single face of the blade.
Figure 1B:
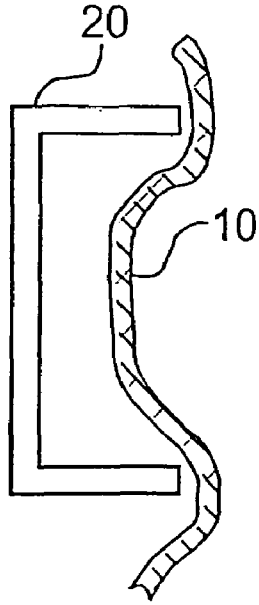
Figure 1C:
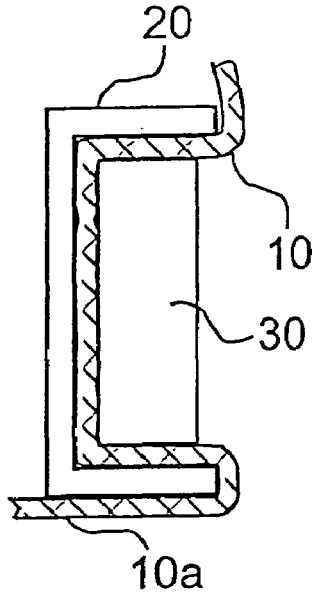

The invention secures the fabric 10 to the blade frame 20 using an elastic band, a spring clamp, any manually operated tensioning device, or any other means which keep the fabric 10 stretched across the blade frame 20 during operation of the fan without detracting from its appearance. See FIGS. 1A through 1C for the securing of fabric 10 against the blade frame 20. FIG. 1A shows a cross section of the frame 20 and a groove 22 in the outward facing side of frame 20. FIG. 1B shows fabric 10 being placed in groove 22. An elastic band is then stretched to a size permitting it to be fitted into groove 22. FIG. 1C shows fabric 10 tightened and secured by elastic band 30 within groove 22 of frame 20. Part 10*a* of fabric 10 is thus stretched across frame 20.

Other methods of securing the fabric 10 to the frame 20 include, but are not limited to the following embodiments. In one such embodiment, shown in cross section in FIG. 1D, an outer hoop 25 surrounding frame 20 and fitting tightly against it is used to clamp the fabric 10 securely once it is stretched across frame 20 to the desired degree of tightness. Outer hoop 25 is concentric with frame 20 and is tightened in groove 22 over fabric 10 by means of a tensioning clasp or other conventional closure device (not shown) to close outer hoop 25 tightly around frame 20.

Figure 1D:
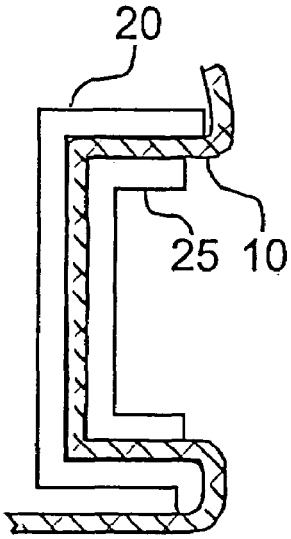
Figure 1E:
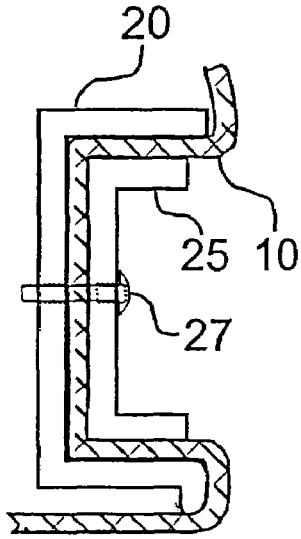

In another embodiment, shown in FIG. 1 E, outer hoop 25 concentric with frame 20 as in FIG. 1D is used. Pins, screws or bolts 27 are inserted through outer hoop 25, fabric 10, and frame 20 to anchor fabric 10 securely once it is stretched across frame 20 to the desired degree of tightness.

Figure 1F:
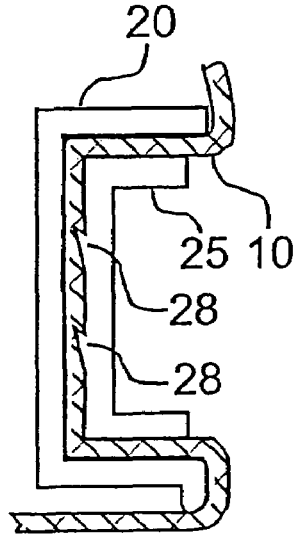

In still another embodiment, shown in FIG. 1F, outer hoop 25 concentric with frame 20 is used as in FIG. 1D, but to provide added security to the fabric clamped between outer hoop 25 and frame 20, outer hoop 25 is fabricated with teeth 28 oriented to oppose the loosening of fabric 10 while it is under tension across frame 20.

Figure 1G:
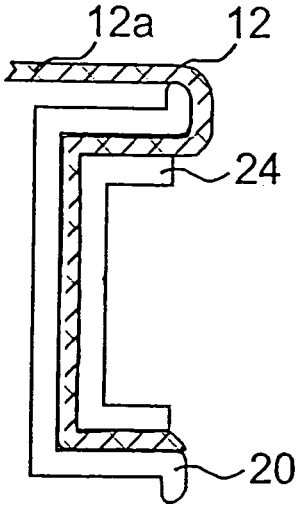
FIGS. 1G through 1L show different methods of attaching the fabric to the fan blade frame to form both faces of the blade.
Figure 1I:
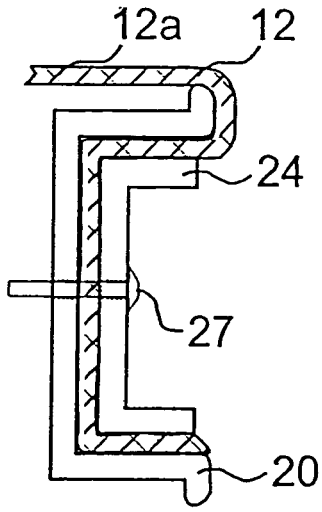

In yet further embodiments, the invention's fan blades may be made with fabric 12 stretched across the top of each fan blade and fabric 10 stretched across the bottom of each fan blade, to prevent accumulations of debris in the cavity made by the frame and the bottom layer of fabric 10. FIG. 1G shows the anchoring of top layer fabric 12 to frame 20 using a first outer hoop 24. FIG. 1H shows the anchoring of bottom layer fabric 10 as in embodiments described earlier to frame 20 using a second outer hoop 25. Both outer hoops are tightened in groove 22 over fabric 10 by means of a tensioning clasp or other conventional closure device (not shown) to close outer hoop 25 tightly around frame 20.

In still another embodiment, shown in FIG. 11, first outer hoop 24 concentric with frame 20 is used to anchor top layer fabric 12 to frame 20 using pins, screws or bolts 27. FIG. 1J shows second outer hoop 25 concentric with frame 20, holding bottom layer fabric 10. Pins, screws or bolts 27 are inserted through outer hoop 25, fabric 10, and frame 20 to anchor fabric 10 securely once it is stretched across frame 20 to the desired degree of tightness.

Figure 1K:
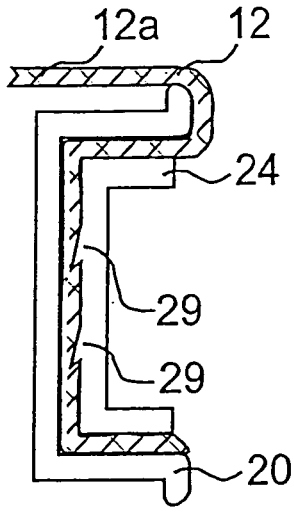
Figure 1H:
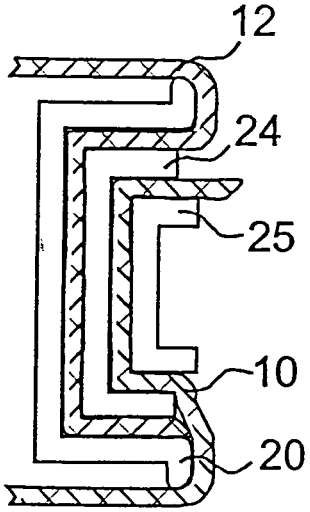
Figure 1J:
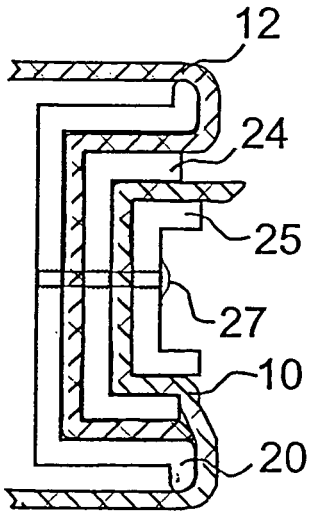
Figure 1L:
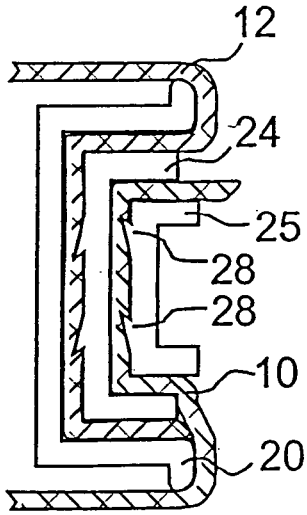

In still another embodiment, shown in FIG. 1K, first outer hoop 24 concentric with frame 20 is used to anchor top layer fabric 12 to frame 20, and second outer hoop 25 concentric with frame 20 is used to anchor bottom layer fabric 10, but o provide added security to the fabric clamped between outer hoop 25 and frame 20, both inner hoop 24 and outer hoop 25 are fabricated with teeth 29 and 28 respectively oriented to oppose the loosening of fabric 12 and fabric 10 while they are under tension across frame 20.

Figure 2A:
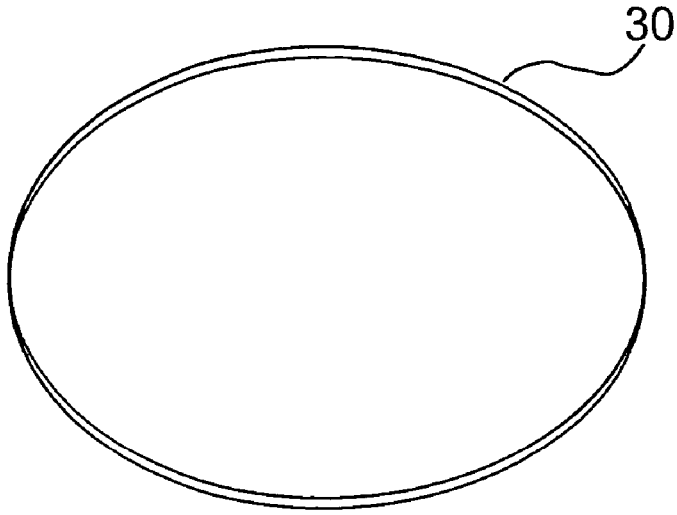
FIGS. 2A through 2D show the process of fastening the fabric to the frame.
Figure 2B:
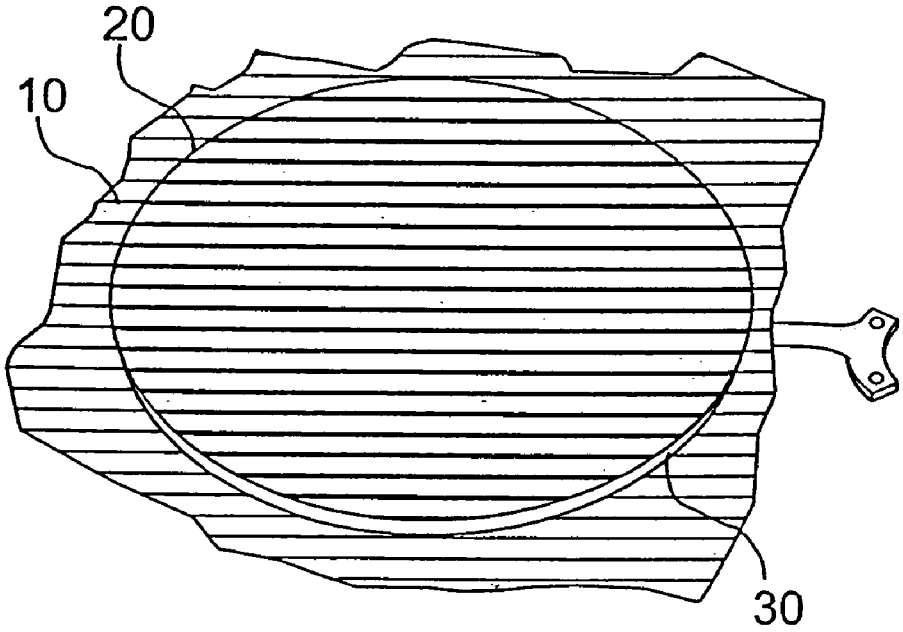
Figure 2C:
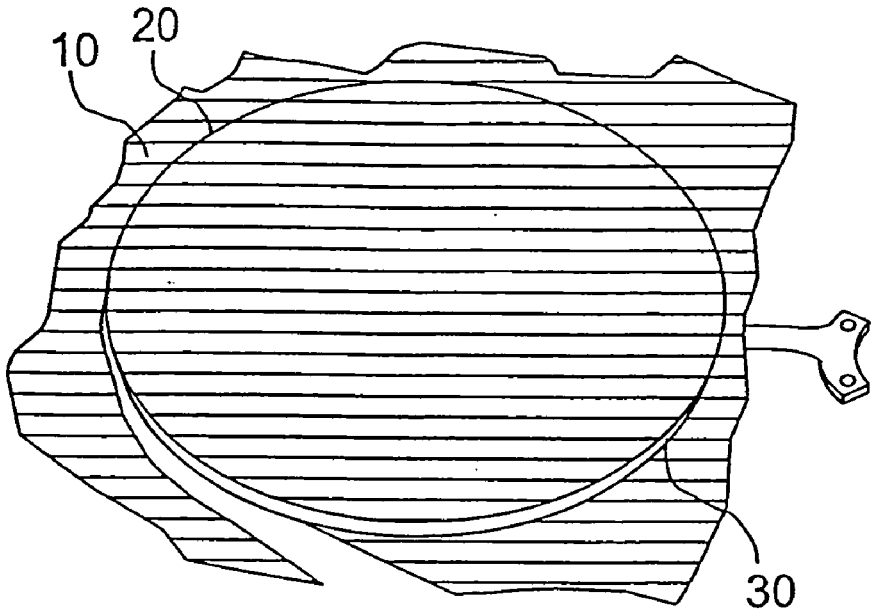
Figure 2D:
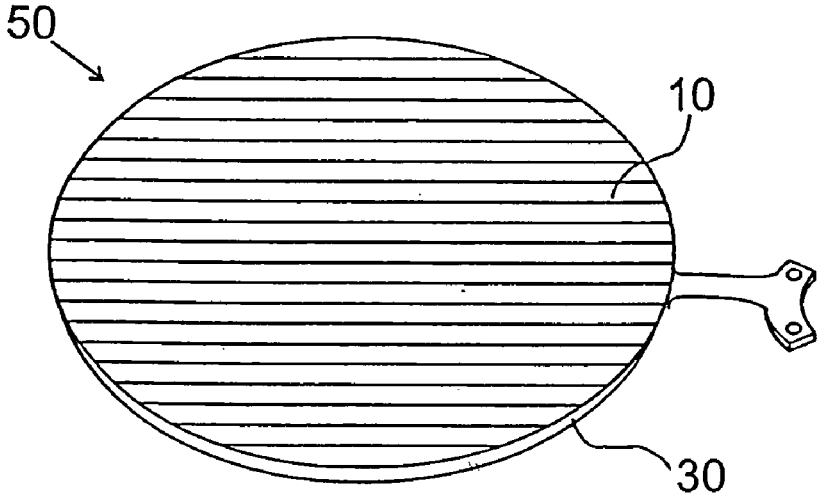

FIG. 2A shows an elastic band 30 to be fitted over the fabric 10 and the frame 20. In the second step, shown in FIG. 2B, the fabric 10 and frame 20 are flipped over together, and the fabric 10 is secured to the frame 20. In a third step, the fabric 10 may be drawn tightly across the fan blade frame 20, and the tensioning means further tightened to secure the fabric 10 in its final configuration. In a fourth and final step, shown in FIG. 2C, the fabric 10 is trimmed to eliminate any excess around the secured edges of fabric 10. The result is a complete fan blade 50, as shown in FIG. 2D.

In some embodiments, the user may choose to leave some slack in the fabric. When the fan is operated, the slack is then taken up by the rotation of the fan against the ambient air, filling out the fan blade to its operating form.

Figure 3:
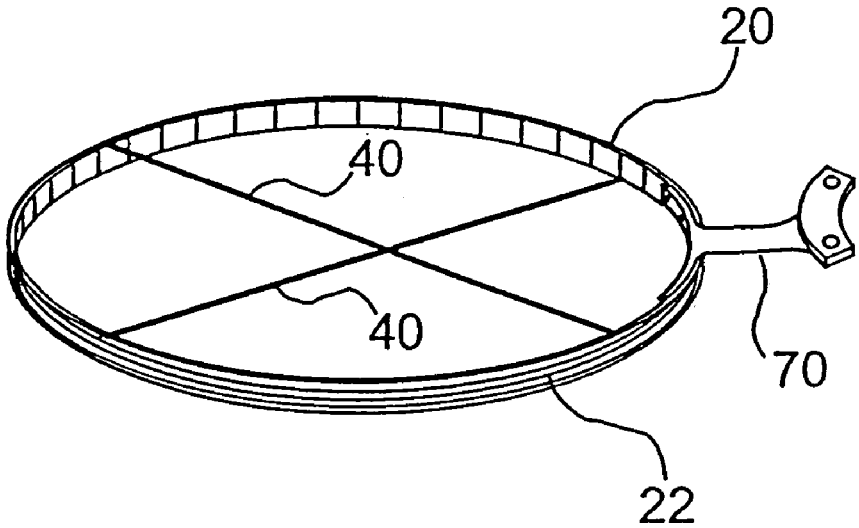
FIG. 3 shows the invention's fan blade frame with added cross braces.

As shown in FIG. 3, a first embodiment of the invention incorporates a retention groove 22 in the outside of the frame 20, in which an elastic band 30 fits over the fabric to hold the fabric in place. All embodiments of the invention may incorporate stabilizing struts 45 or cross members 40 attached at various points on the frame 20 to keep the frame 20 from racking or twisting out of shape. The configuration of these stabilizing members 40 will depend on the desired size and shape of the completed fan blade 50.

The invention's fan blades 50 may take any shape consistent with the need to maintain adequate tension in the fabric, and consistent with the need to circulate air effectively. A typical fan blade of the invention is elliptical in shape, as shown in FIGS. 1, 2A through 2D, and 3. The set of usable blade frame shapes includes, but is not limited to, circular, polygonal, concave-sided, or irregular shapes. Common convex shapes are shown in FIGS. 3A through 3F. All of these figures show struts 45 supporting opposite sides of fan blade frame 20. In addition to different shape embodiments, the invention's fan blades may also comprise multiple elements each of the same or different shape. The combinations of shapes and multiple fan blade elements offer many decorative possibilities to the invention's user.

The light weight of the invention's fan blades makes possible the fabrication and use of fan blades with large surface area. See FIGS. 3G and 3H, showing the fan blades 50 of FIG. 1 mounted to fan motor 80 with fan blade struts 70.

Figure 3A:
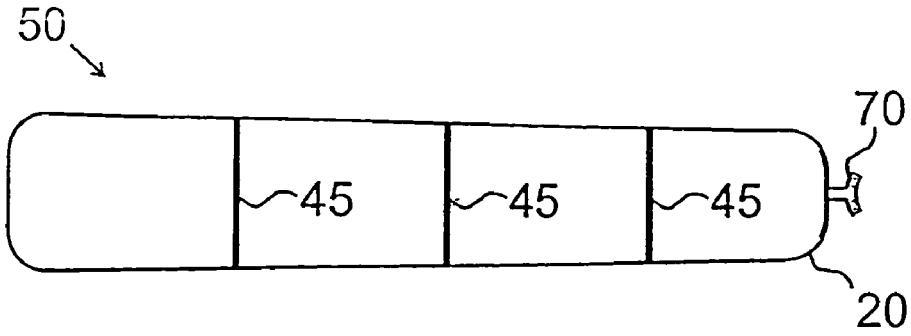
FIGS. 3A through 3F show different shapes of the invention's fan blades.
Figure 3B:
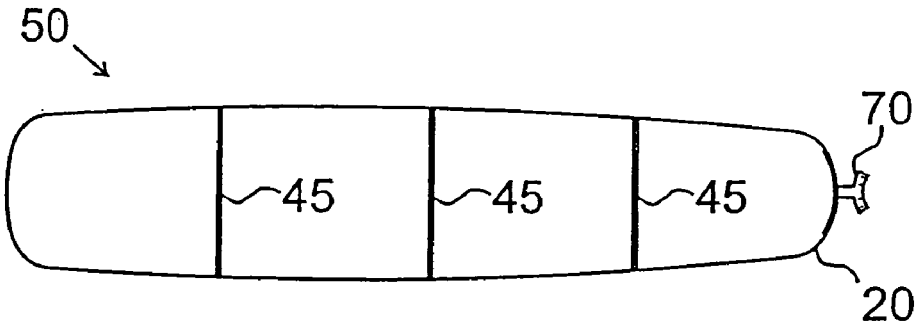
Figure 3C:
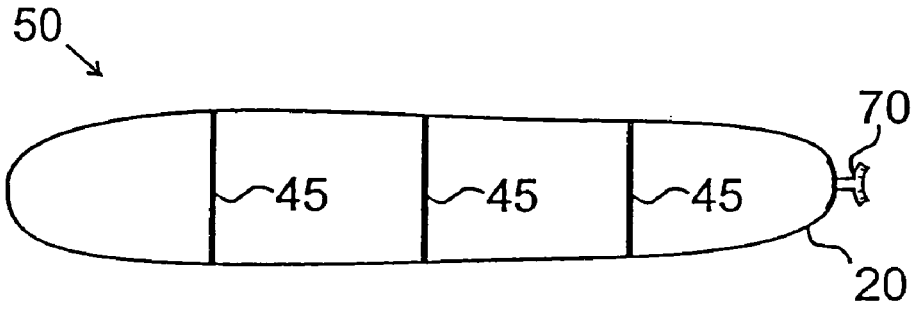
Figure 3D:
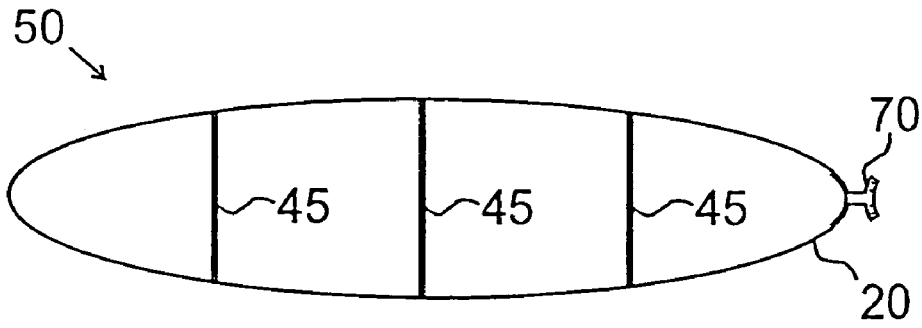
Figure 3E:
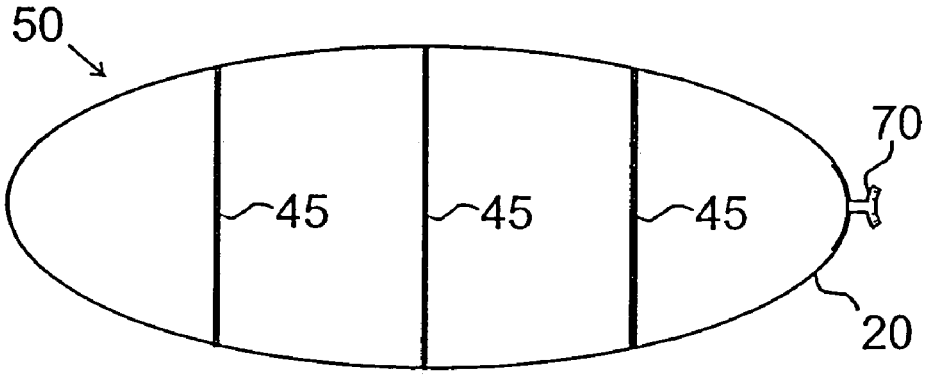
Figure 3F:
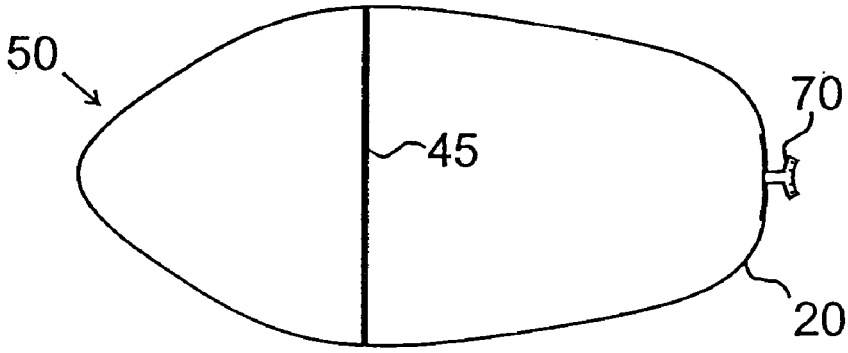
Figure 3G:
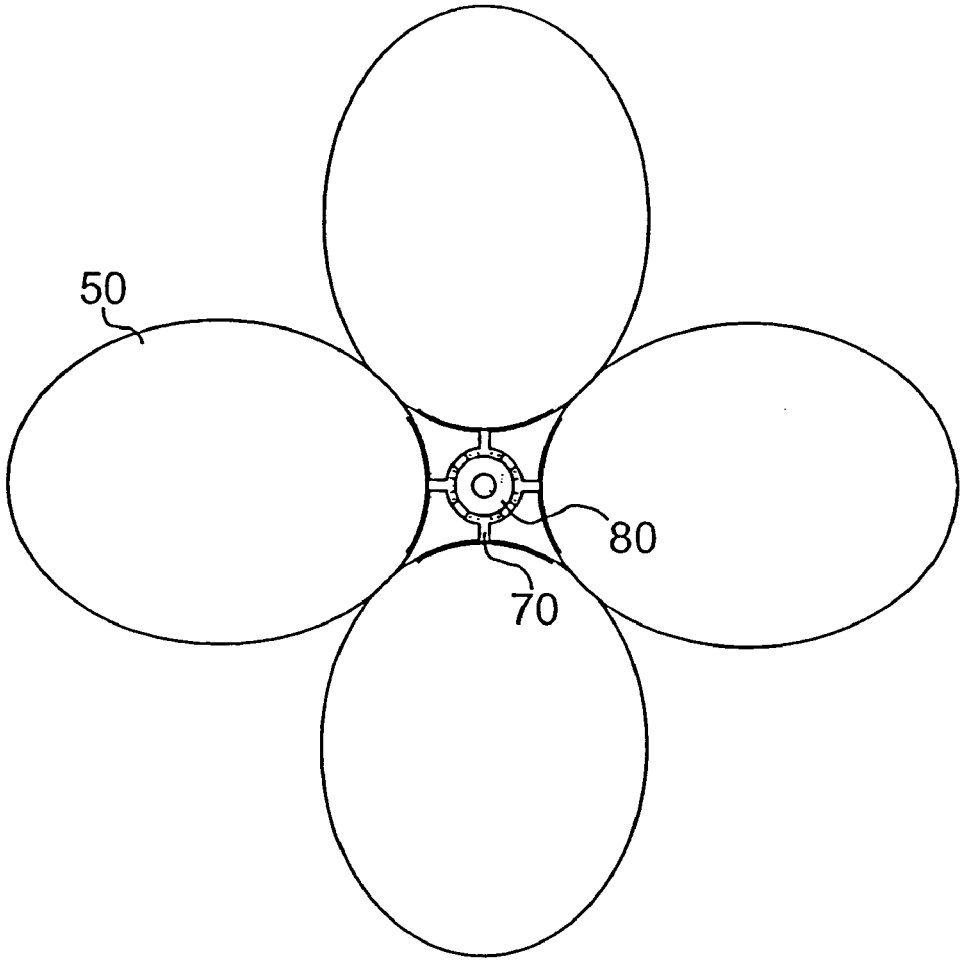
FIGS. 3G and 3H show the orientation of the invention's fan blades with respect to the fan motor housing.
Figure 3H:
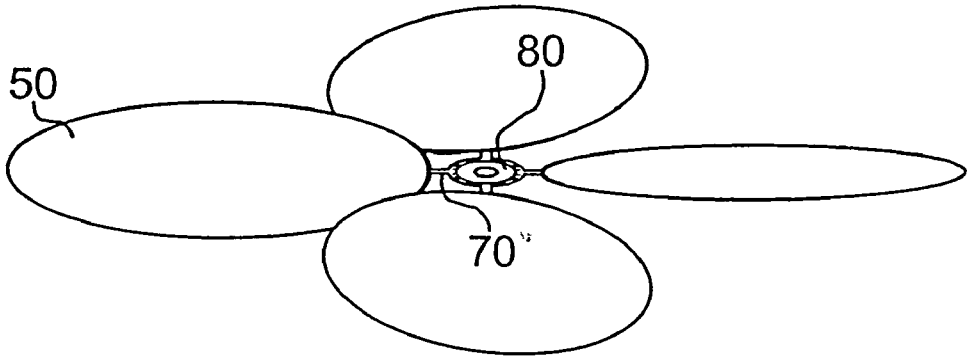
Figure 3I:
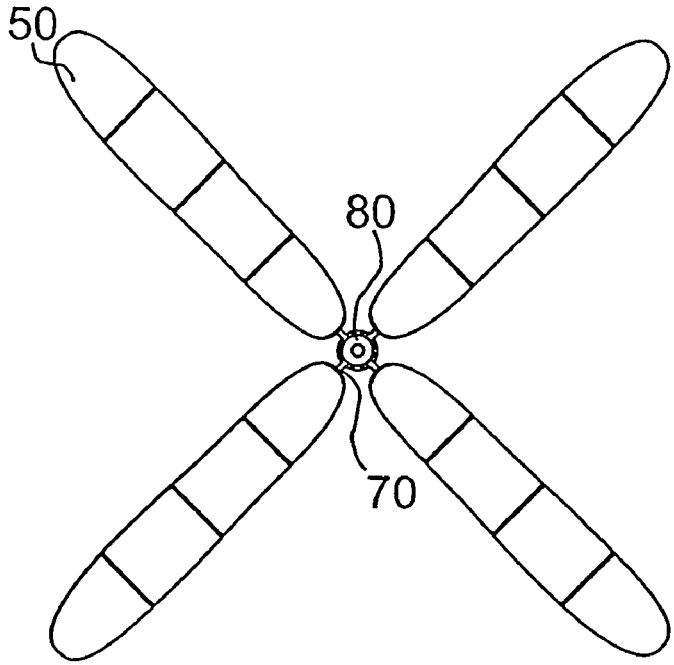
Figure 3J:
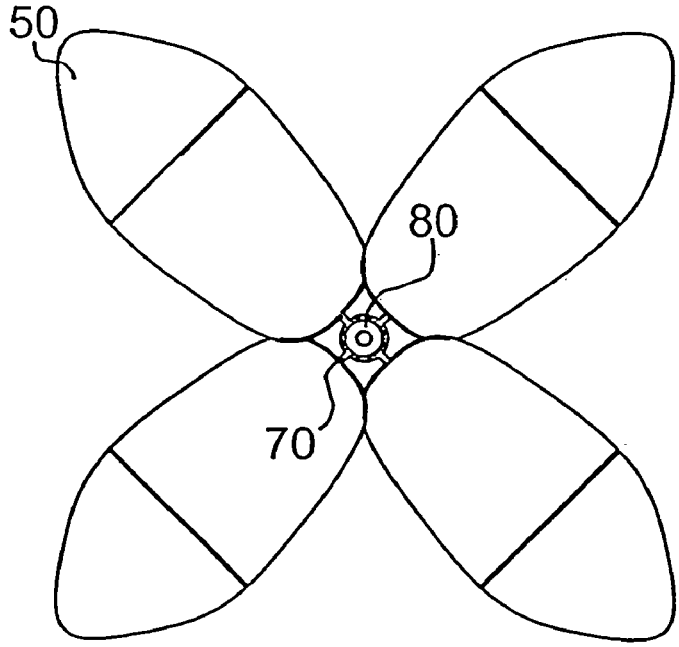
Figure 3K:
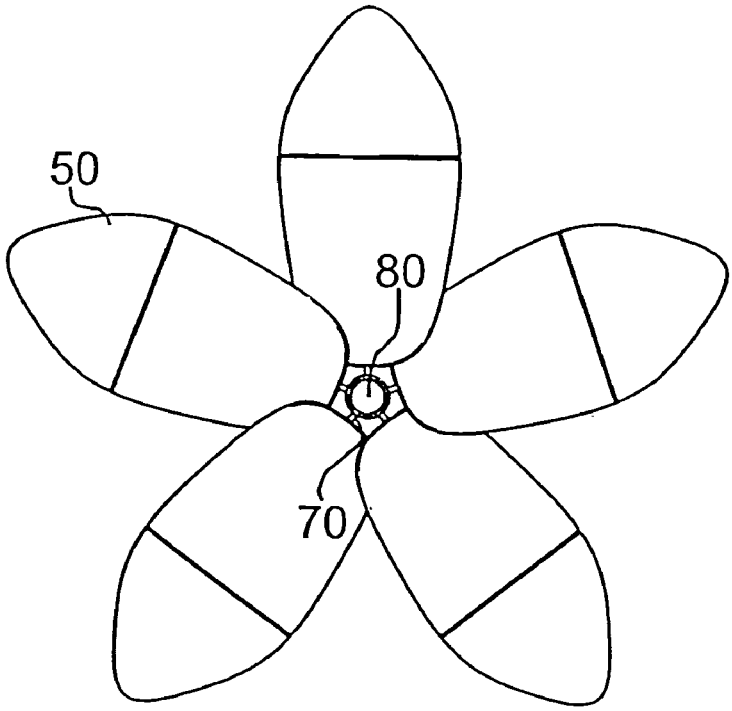
FIGS. 3K and 3L show a top and bottom view respectively of the fan using the fan blade of FIG. 3F.
Figure 3L:
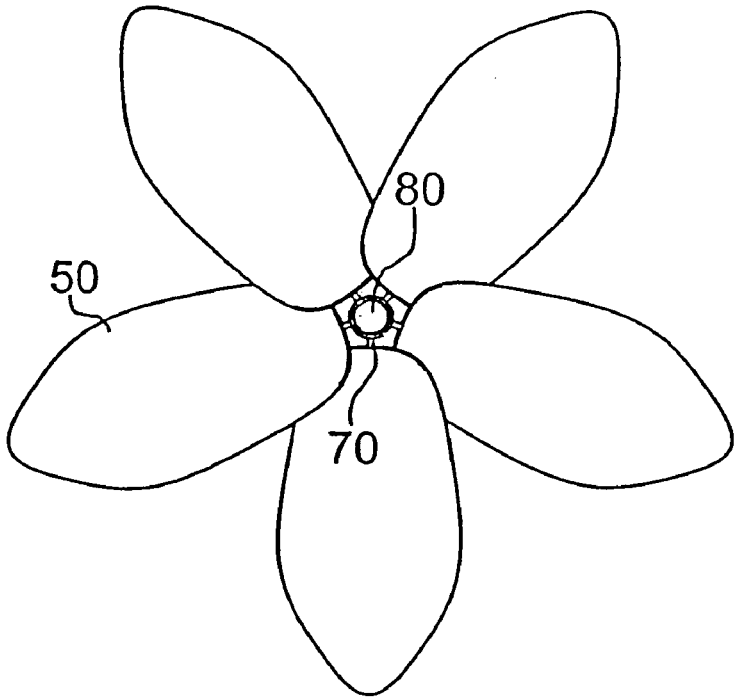

FIGS. 31 and 3J show the fan blades 50 of FIGS. 3C and 3F respectively mounted to fan motor 80 with fan blade struts 70. FIGS. 3K and 3L show respective top and bottom views of the fan blades 50 of FIG. 3F mounted to fan motor 80 with fan blade struts 70. The overlap of fan blades 50 shown in FIGS. 3K and 3L provides additional decorative appeal to the invention's fan's appearance.

In still another class of embodiments (not shown), the fabric used to form the operating surfaces of the fan blade may be cut and formed with decorative openings to appear in each blade.

Figure 4A:
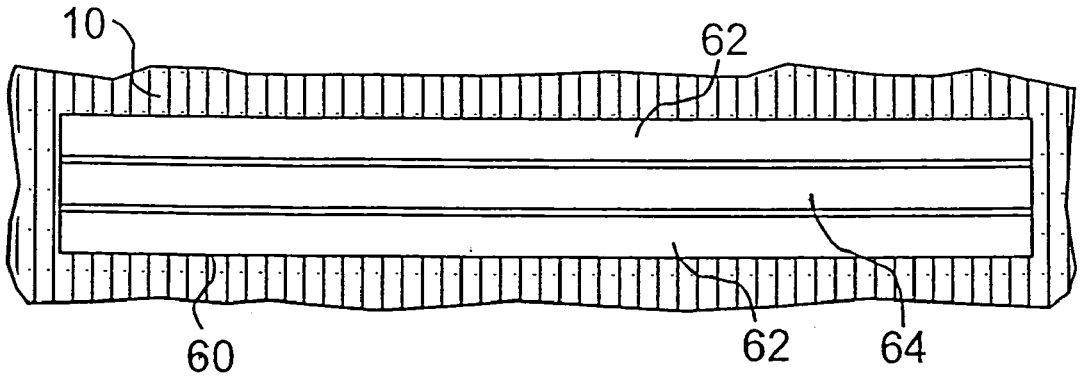
FIGS. 4A, 4B, and 4C show the process of attaching fabric to the fan motor housing.
Figure 4B:
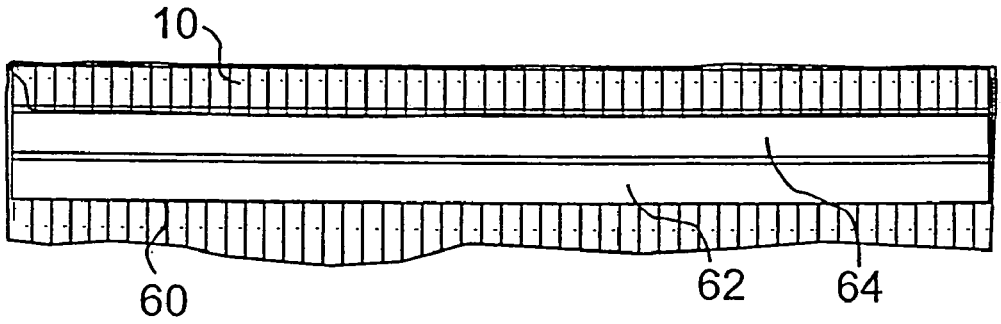
Figure 4C:
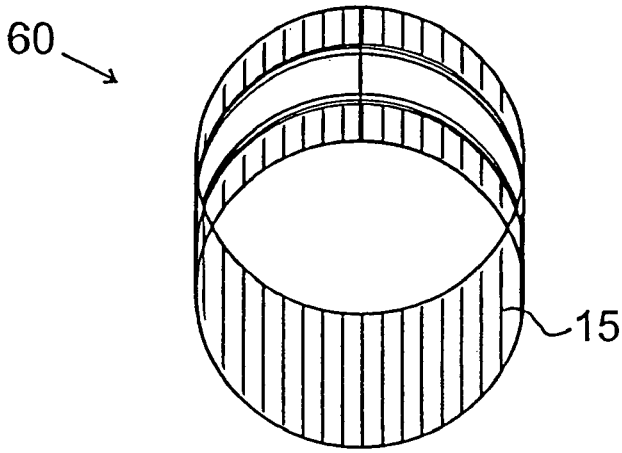

See FIGS. 4A through 4C. The invention further comprises a supportive band 60 which encircles the fan motor housing. Fabric 10 is stretched and secured over supportive band 60 to provide a decorative surface trim band 15 for the fan motor housing. The fabric trim band 15 on the fan motor housing may also be changed without the use of tools or other extensive procedures. One embodiment uses a supportive band 60, such as a piece of spring steel or plastic sheet, fabricated in a curved form of slightly smaller curvature radius than the curvature radius of the fan motor housing. The fabric 10 is secured to the band 60 by means of tape or adhesive 62. Once the fabric 10 is secured to the band 60, the resulting fabric trim band 15 is then wrapped around the circumference of the motor housing. The supportive band 60 stays in place by means of the compression against the housing created by the tendency of the band 60 to curl to its nominal shape.

In an alternate embodiment, the supportive band 60 has a pre-attached magnetic strip 64 that locks onto the metal fan motor housing. In still another embodiment (not shown), the fabric-covered band 60 is attached to the housing with Velcro or other closure methods that render the band 60 easily attachable and removable.

In most applications, the fabric 10 on the blades is also used as the trim band on the fan body. In other applications, the fabric is used separately on either the blades or fan body, or two distinct fabrics are used on blades and fan body.

Figure 5:
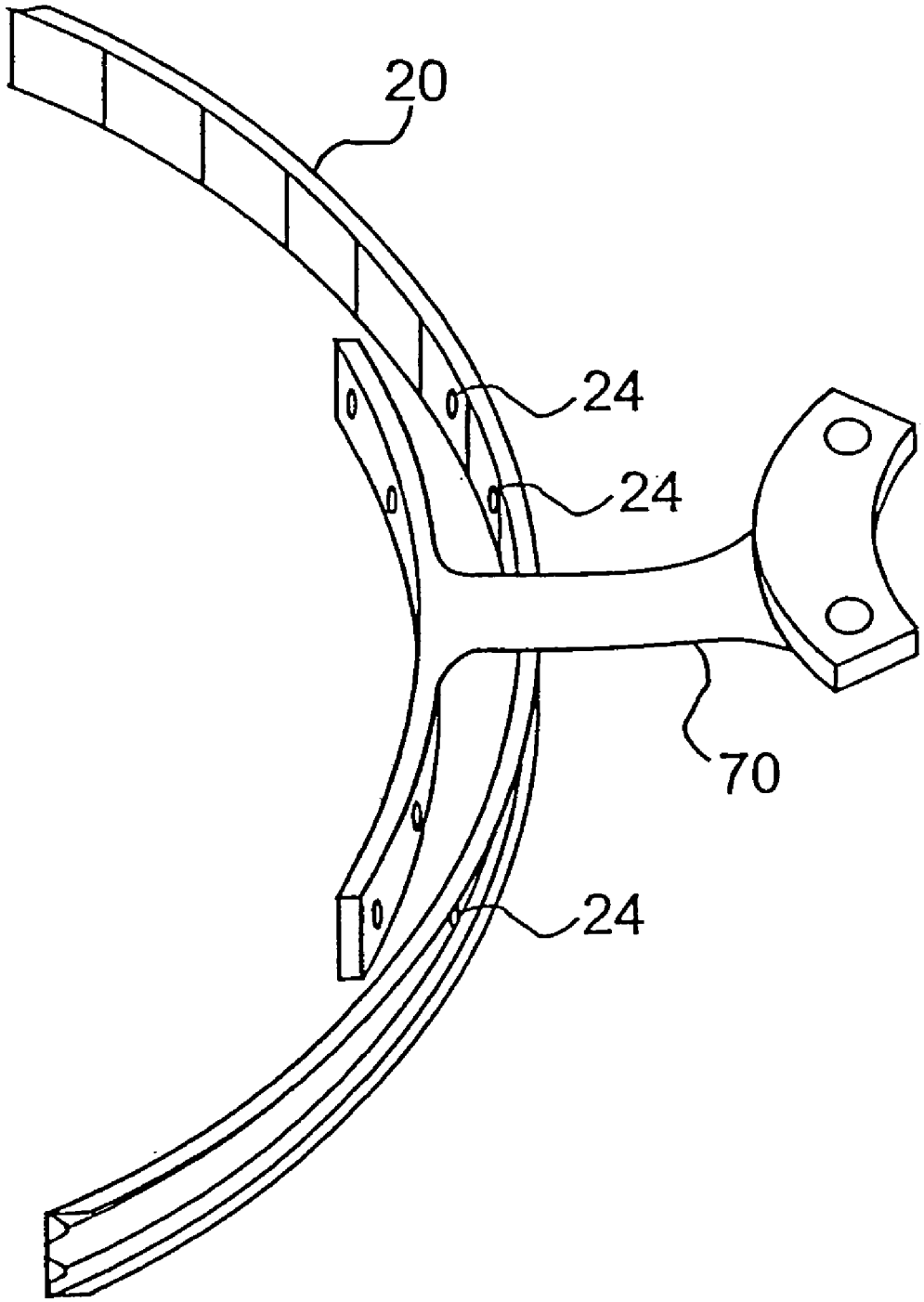
FIG. 5 shows details of the strut attaching the fan blade to the drive shaft of the fan motor housing.

The invention's fan blade attaches to the fan motor in the conventional manner of ceiling fan blades. See FIG. 5. The fan blade frame 20 is fabricated with holes 24 for screws or bolts for fastening the fan blade frame 20 typically to a strut 70 connected to the fan's rotating shaft.

Figure 6:
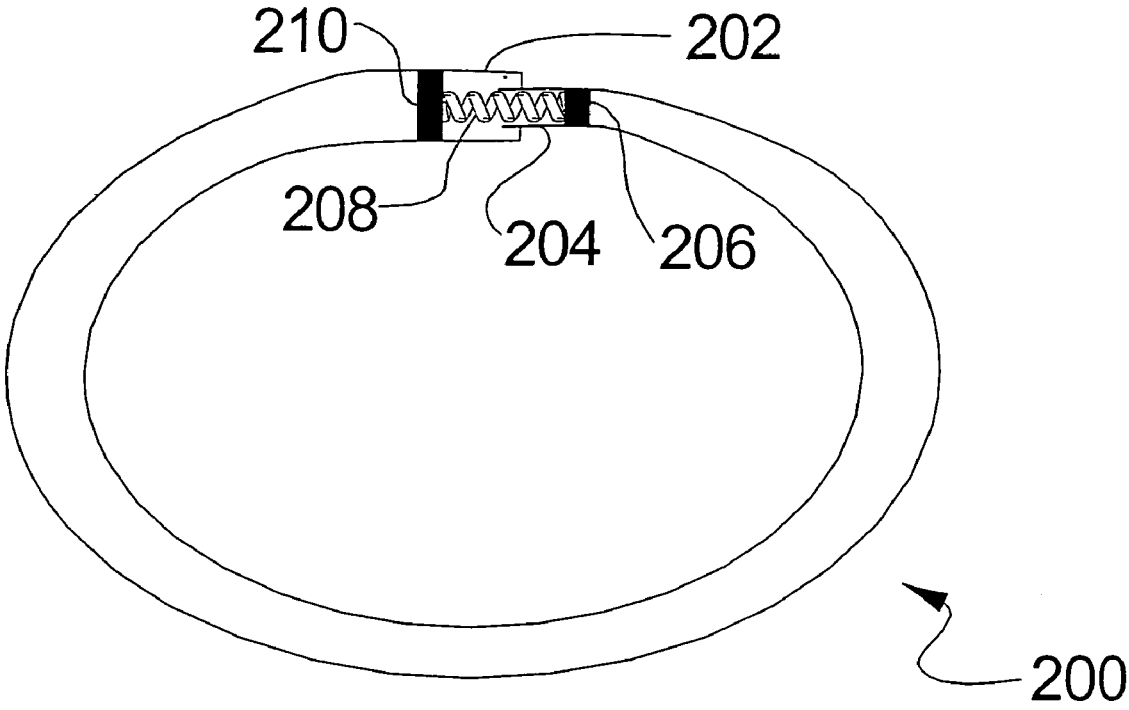
FIG. 6 is a view of an expansion ring that holds fabric against the inside wall of the blade frame.

The embodiments of the invention shown above provide an outer compression member that compresses and hold the fabric against an outer wall of a frame with an annular shape that encloses an open space inside the annulus. Those skilled in the art understand that the structure the fabric can be held against the inner wall of the annular frame if one uses fixed fasteners (pins, screws or bolts) or an expansion member. For example, a hoop could be placed inside the frame and have its length extended to exert an outward force against the inside wall of the annular frame. The hoop could be held in place with a clamp. As an alternative, the hoop may comprise an expansion ring 200 as shown in FIG. 6. It has an elongated body that has either a taper or a reduced diameter at one end 204 to fit inside the opposite end. 202. The opposite ends have spring retainer blocks 206, 210 and a spring 208 that is biased to push the ends apart. The circumference of the ring 200 is reduced by pressing the tapered end 204 inside the larger end 202. The ring is set inside the frame 20 and inside the fabric 10. Upon release of the ends, the ring expands to press the fabric 10 against the inner facing wall of the frame 20.

The invention provides a decorative, lightweight, and easily changeable fan blade usable on any ceiling fan for circulating air. The fan blades of the invention have less mass than conventional fan blades and their lower mass allows for significant reductions in power consumption, stress, wear, and tear on the fan's ceiling mountings. The invention's fan blade may take any of a wide range of shapes, sizes, and structures, offering advantages of both appearance and function in comparison to conventional ceiling fans. As such, the invention may be practiced in a variety of embodiments including ones shown here and other embodiments that are insubstantial modifications of the invention as claimed herein.

What is claimed is:

1. A powered ceiling fan for the circulation of air, comprising:

a fan body, further comprising a fan motor, a shaft operably connected to the fan motor, two or more struts connected to the shaft, and a fan motor housing for covering the fan motor and shaft;

two or more fan blade frames, each anchored to a strut and defining an outward-facing groove;

one or more sheets of fabric each stretched across each fan blade frame; and one or more fasteners securing each sheet of fabric to one of the outward-facing grooves.

2. The powered ceiling fan of claim 1 further comprising reinforcements for each fan blade frame.

3. The powered ceiling fan of claim 2 wherein the reinforcements comprise struts connected to the frame and applying supporting pressure to the frame.

4. The powered ceiling fan of claim 2 wherein the reinforcements comprise cross members connected to the frame and applying tension to the frame.

5. The powered ceiling fan of claim 1 wherein the one or more fasteners comprise one or more tensioning devices.

6. The powered ceiling fan of claim 1 wherein the fan blade frame comprises a substance selected from the group consisting of metals, plastics, and woods.

7. The powered ceiling fan of claim 1 wherein the sheet of fabric comprises a fabric selected from the group consisting of cotton, linen, silk, wool, nylon, rayon, acetate, polyester, and combinations thereof.

8. The powered ceiling fan of claim 1 wherein the sheet of fabric bears a decorative pattern.

9. The powered ceiling fan of claim 8 wherein the decorative pattern comprises one or more substances selected from the group consisting of paints, dyes, washes, stains, or inks.

10. A decorative fan blade for the circulation of air, comprising:

a fan blade frame defining an outward-facing groove;

one or more sheets of fabric each stretched across the fan blade frame; and one or more fasteners securing each sheet of fabric to the outward-facing groove.

11. The ceiling fan of claim 10 wherein the fastener exerts a force against the fabric and the frame in a direction toward an open space enclosed by the frame.

12. The decorative fan blade of claim 10 further comprising reinforcements for each fan blade frame.

13. The decorative fan blade of claim 12 wherein the reinforcements comprise struts connected to the fan blade frame and applying supporting pressure to the fan blade frame.

14. The decorative fan blade of claim 12 wherein the reinforcements comprise cross members connected to the fan blade frame and applying tension to the fan blade frame.

15. The decorative fan blade of claim 10 wherein the one or more fasteners comprise one or more tensioning devices.

16. The decorative fan blade of claim 10 wherein the fan blade frame comprises a substance selected from the group consisting of metals, plastics, and woods.

17. The decorative fan blade of claim 10 wherein the sheet of fabric comprises a fabric selected from the group consisting of cotton, linen, silk, wool, nylon, rayon, acetate, polyester, and combinations thereof.

18. The decorative fan blade of claim 10 wherein each sheet of fabric bears a decorative pattern.

19. The decorative fan blade of claim 18 wherein the decorative pattern comprises one or more substances selected from the group consisting of paints, dyes, washes, stains, or inks.

20. A decorative fan blade for the circulation of air, comprising:

a fan blade frame;

one or more sheets of fabric each stretched across the fan blade frame; and an elastic band concentric with and outside of the fan blade frame for keeping each sheet of fabric stretched across the fan blade frame;

wherein the elastic band is secured around the fan blade frame by a groove in the fan blade frame.

21. The decorative fan blade of claim 20 further comprising reinforcements for each fan blade frame.

22. The decorative fan blade of claim 21 wherein the reinforcements comprise struts connected to the fan blade frame and applying supporting pressure to the fan blade frame.

23. The decorative fan blade of claim 21 wherein the reinforcements comprise cross members connected to the fan blade frame and applying tension to the fan blade frame.

24. A method for fabricating a fan blade, comprising the steps of:

fabricating a fan blade frame around an open space, the fan blade frame having an outward-facing groove;

stretching one or more layers of fabric across the fan blade frame to cover the open space;

fastening the one or more layers of stretched fabric to the outward-facing groove of the fan blade frame; and trimming excess fabric from the layers of stretched fabric to produce a finished fan blade.

25. The method of claim 24 wherein the step of fabricating a fan blade frame around an open space further comprises the step of inserting one or more struts in the frame to provide pressure to keep it from deforming inward.

26. The method of claim 24 wherein the step of fabricating a fan blade frame around an open space further comprises the step of inserting one or more cross braces in the frame to provide tension to keep it from deforming.

27. The method of claim 24 wherein the step of fastening the one or more layers of stretched fabric to the fan blade frame further comprises the step of stretching an elastic band to fit tightly over the stretched fabric to hold it to the fan blade frame by friction.

28. The method of claim 24 wherein the step of fastening the one or more layers of stretched fabric to the fan blade frame further comprises the step of tightening a spring clamp over the stretched fabric to hold it to the fan blade frame by friction.

* * * * *